United States Patent [19]

Tamamori

[11] Patent Number: 5,046,921

[45] Date of Patent: Sep. 10, 1991

[54] MOISTURE-REMOVAL DEVICE FOR A COMPRESSED AIR SYSTEM

[75] Inventor: Hideo Tamamori, Kobe, Japan

[73] Assignee: Nippon Air Brake Co., Ltd., Kobe, Japan

[21] Appl. No.: 542,291

[22] Filed: Jun. 22, 1990

[30] Foreign Application Priority Data

Jul. 4, 1989 [JP] Japan ..... 1-79021[U]

[51] Int. Cl.[5] ..... F03B 11/08

[52] U.S. Cl. ..... 415/121.2; 415/121.3; 415/169.2; 55/316; 210/DIG. 6

[58] Field of Search ..... 415/121.2, 121.3, 169.1, 415/169.2; 55/316; 210/DIG. 6

[56] References Cited

U.S. PATENT DOCUMENTS 4,758,254 7/1988 Hata ..... 55/316
4,816,047 3/1989 Neal ..... 55/316
4,946,485 8/1990 Larsson ..... 55/316

FOREIGN PATENT DOCUMENTS 0260301 9/1928 Italy ..... 210/DIG. 6

*Primary Examiner*—Edward K. Look
*Assistant Examiner*—Christopher M. Verdier
*Attorney, Agent, or Firm*—G. J. Falce

[57] ABSTRACT

A filter arrangement for a moisture-removal device used in compressed air systems in which an inner filter adapted to remove water from the air is encircled by an outer filter that is adapted to remove oil from the air. A space between the inner and outer filters is provided to accommodate accumulation of the filtered-out oil with a valving arrangement provided in the area of oil accumulation that is operative in response to a pressure differential when the regeneration phase of operation is initiated to concurrently discharge the accumulated oil.

11 Claims, 3 Drawing Sheets

MOISTURE-REMOVAL DEVICE FOR A COMPRESSED AIR SYSTEM

BACKGROUND OF THE INVENTION

This invention relates to a moisture-removal device installed in a compressed air system, and in particular to a moisture-removal device having an adsorbent, which is arranged to be regenerated periodically, for removing the water and oil contained in the compressed air supplied by the air compressor.

As is known already, the air pressure equipment in a railroad car, etc., is operated by compressed air from the air compressor. This compressed air contains water and contaminants such as oil, etc., and these contaminants must be removed before the air is used. Therefore, a moisture-removal device is normally installed between the air compressor and the main air reservoir in this type of compressed air system. One example of this type of moisture-removal device is disclosed in Utility Model Kokai No. 56-2733.

This device comprises, as can be seen in FIG. 6, a flow inlet 2, a flow outlet 3 and a drain outlet 4 on one side of the main body 1. The above-mentioned flow inlet 2 is connected to the air compressor 5, and the above-mentioned flow outlet 3 is connected to the regenerating air reservoir 6. The above-mentioned drain discharge outlet 4 is connected to the discharge valve 7. The above-mentioned regenerating air reservoir 6 is connected to the air pressure equipment of the air brake system via the main air reservoir. The above-mentioned discharge valve 7 is constructed so that it connects the drain discharge outlet 4 to the atmosphere or blocks it from the atmosphere, based on the position of a switch. On the other hand, inside the main body 1, there is a cylindrical chamber 10 which consists of an inner cylinder 9 of which the bottom is opened. Inside this cylindrical chamber 10 is housed the adsorbent 11, in which the adsorbent particles are formed and fixed porously in a cylindrical form. A belt-shaped filter 12 is wound on the outer circumference of this adsorbent 11, with gaskets 13 and 14 installed on the upper end and the lower end of this belt-shaped filter 12. Each of these structural components is supported by the cap plate 16 which is fixed on the main body 1 by the bolt 15.

When the above-mentioned air compressor 5 operates, the compressed air flows to the inside of the main body 1 from the flow inlet 2, and travels along the path indicated by the arrows, to the regenerating air reservoir 6 and to the main air reservoir 8, and is stored there.

In more detail, the compressed air at the above-mentioned flow inlet 2, enters into the inner circumferential space 18 of the inner cylinder 9, via the outer circumferential path 17 and thence passing through the belt-shaped filter 12, where its oil is removed. As the air continues along its way through the adsorbent 11, water is removed and the air becomes dried compressed air. This dried compressed air passes through the inner hole 19 and through holes 20 and 21, and it moves the check valve 21 upwardly, whereupon it reaches the above-mentioned flow outlet 3, passing through the discharge path 22.

When the operation of the above-mentioned air compressor 5 is stopped, the discharge valve 7 is opened by the switching action which accompanies the operation of the air compressor, and the drain discharge outlet 4 is connected to the atmosphere, so that the compressed air in the regenerating air reservoir 6 flows back through the discharge path 22, in bypass of check valve 21, via an orifice 23, where it expands, so that it becomes drier than before. This dried air soaks up the water from adsorbent 11 by passing through the adsorbent 11 in the reverse direction, and it reaches the drain discharge outlet 4, and as a result, the adsorbent 11 is regenerated.

In the above-mentioned moisture-removal device, the belt-shaped filter 12 is wound around the outer circumference of the adsorbent 11, so that when the amount of the oil deposited on this belt-shaped filter 12 becomes excessive, the pressure difference between the inner circumference side and the outer circumference side of the belt-shaped filter 12 becomes large at the time when the compressed air is supplied (during the moisture-removal phase), and because of this pressure difference, the oil enters into the adsorbent 11, and this causes a deterioration of its capability. In addition, at the time of discharge (during the regeneration phase), the belt-shaped filter 12 becomes a barrier, and the oil inside the adsorbent 11 cannot be released to the outside, which represents a disadvantage.

Therefore, in order to eliminate these disadvantages, as can be seen in FIG. 7, the method used is one in which the oil in the belt-shaped filter 12 is prevented from entering directly into the adsorbent 11 by forming a space 24 between the outer circumference of the adsorbent 11 and the belt-shaped filter 12. In addition, as can be seen in FIG. 8, a thin pipe **12*x*, which is traversed by many holes, is fitted with the inner circumference of the above-mentioned belt-shaped filter 12 to form this space 24. In addition, as can be seen in FIG. 7, the mesh-shaped tube 19*x*, which holds the broken pieces of the adsorbent 11 when the adsorbent loses its shape, is inserted in the inner hole 19 of the adsorbent 11**.

However, even with the space 24 provided between the adsorbent 11 and the belt-shaped filter 12, as mentioned above and as shown in FIG. 8, during the supply of compressed air A, the oil droplets B that are deposited on the belt-shaped filter 12, run down along the inner circumferential surface as is indicated by the arrows, and an oil puddle X is formed in the area where the lower side of gasket 14 and the lower end (sealing member **12*a*) of the belt-shaped filter 12 meet. This oil puddle X remains in this position during the discharge of the compressed air A' indicated in FIG. 9. Thus, when the oil puddle is formed, and if it remains like this, the oil will enter into the inside of the adsorbent 11** from the puddle X during the supply of the compressed air A, and therefore the capability of the adsorbent becomes deteriorated in the lower part, which represents a problem.

SUMMARY OF THE INVENTION

Therefore, considering the above-mentioned problem, the object of this invention, is to provide a moisture-removal device that prevents the formation of an oil puddle in the area where the lower gasket (or the cap plate) and the belt-shaped filter come into contact, in order to extend the life of the adsorbent.

Briefly, this objective is achieved by a unique moisture-removal device for use in a compressed air system including an air compressor for supplying air to a main reservoir via a regeneration reservoir. The moisture-removal device includes a main body in which is formed a chamber with a first port via which the chamber is connected to the air compressor and a second port via which the chamber is connected to the regeneration reservoir, and a filter assembly fixed in said chamber between the compressor and regeneration reservoir. The filter assembly includes a first filter formed of adsorbent particles, a second filter surrounding the first filter in spaced-apart relationship therewith to form a cavity therebetween, upper and lower plate members between which the first and second filters are clamped in place, and seal means between the second filter and at least the lower plate member for interrupting fluid pressure communication between the cavity and chamber. The seal means includes differential pressure responsive valve means for establishing fluid pressure communication between the cavity and chamber when the chamber is vented to atmosphere.

BRIEF EXPLANATION OF THE DRAWINGS

These and other objects and advantages of the invention will be apparent from the following more detailed explanation of the invention when taken in conjunction with the accompanying drawings in which.

DESCRIPTION AND OPERATION

Figure 8:
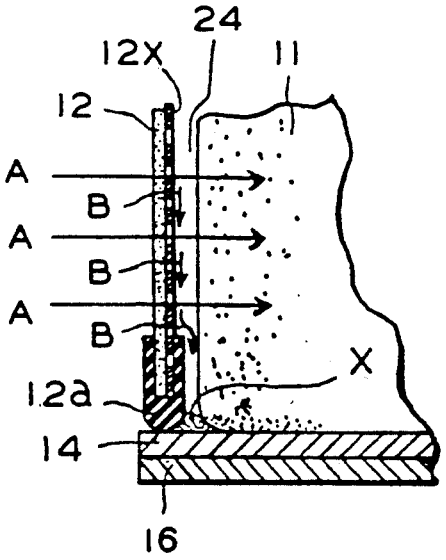
FIG 8 PRIOR ART
FIGS. 8 and 9 are fragmentary elevational views of an air-removal device employing the improved arrangement of the known filter of FIG. 7 illustrating its attendant disadvantages.
Figure 9:
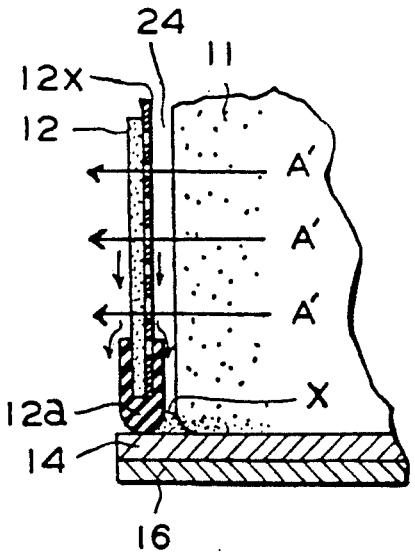
FIG 9 PRIOR ART
Figure 6:
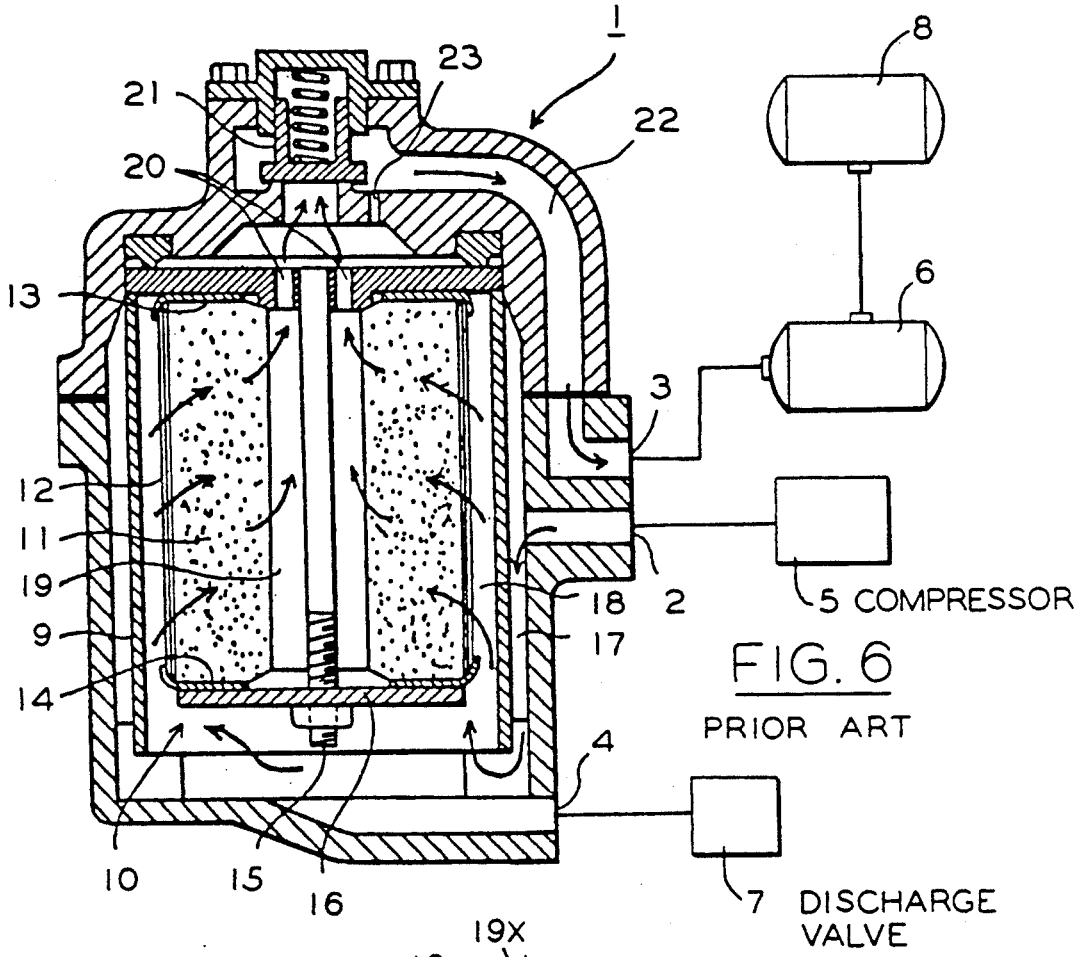
FIG. 6 PRIOR ART
FIG. 6 is a sectional front elevation view of an air-removal device of known construction shown arranged in a compressed air supply system.
Figure 7:
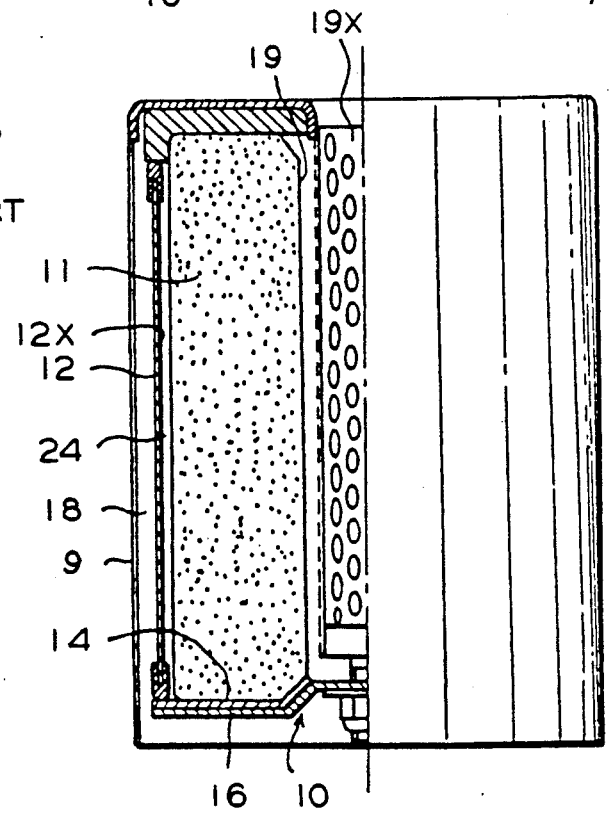
FIG. 7 PRIOR ART
FIG. 7 is an elevation view partly in section and partly in outline showing a known filter having an improved construction over the filter arrangement of FIG. 6.

The following is a detailed explanation of one embodiment of this invention with reference to the accompanying FIGS. 1 to 5. The moisture-removal device 1, in the embodiment described below, has the same overall structure as the above-mentioned example of the prior art indicated in FIG. 6, so that the explanation has been omitted here. In addition, the inner structure of the cylindrical chamber 10 indicated in FIG. 7 is also approximately the same as the example of the prior art, so that the explanation has been omitted. Also, the structural components which are the same as those of the example of the prior art illustrated in FIGS. 8 and 9, are marked the same, and their explanation has been omitted.

Figure 1:
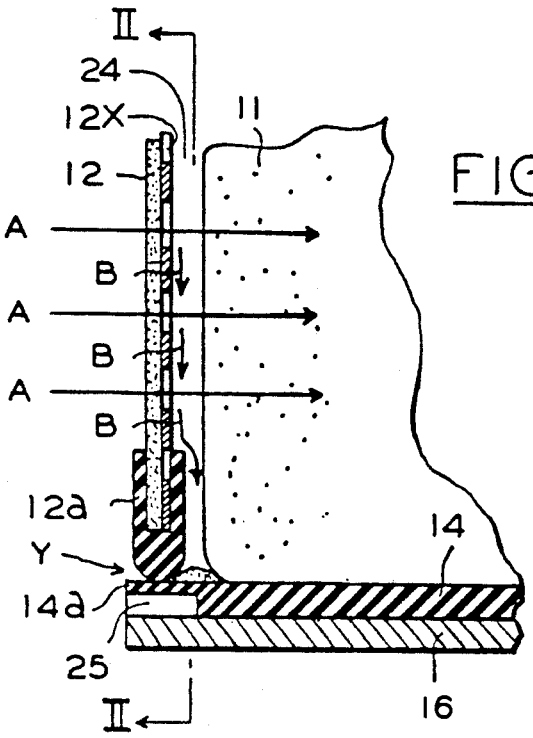
FIG. 1 is a partial sectional, front elevation view illustrating one embodiment of the invention.
Figure 2:
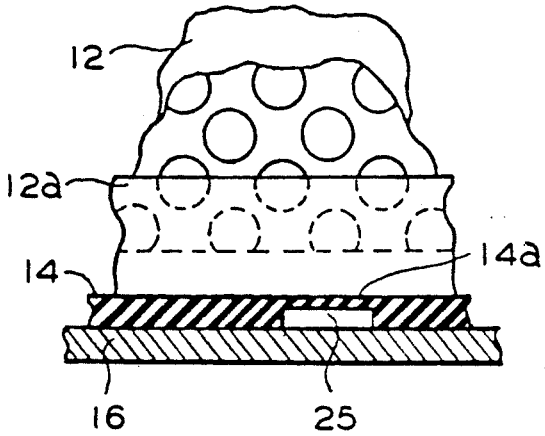
FIG. 2 is a fragmentary sectional, elevation view taken along the lines II—II in FIG. 1.

The first embodiment of this invention will be explained as follows below. As can be seen in FIGS. 1 and 2, an indented (concave) part 25 of gasket 14 is formed by undercutting the outer periphery of the gasket a specified width and depth along the lower surface of the gasket at its outer circumferential rim where the lower end (sealing member 12*a*) of the belt-shaped filter 12 contacts it. In this manner, the part above the indentation 25 in this gasket 14 becomes a thin flap 14*a*.

This gasket 14 is made of an elastic material such as rubber, resin, etc., so that the above-mentioned thin flap 14*a* is easily deformed, based on the pressure difference between the inner space and the outer space of the belt-shaped filter 12, in order to open or close the contact point Y where the lower end of the filter 12 contacts the gasket 14. Therefore, in this first embodiment, there is provided an open-close, valve-like mechanism in which flap 14*a* constitutes a movable valve element and the lower end 12*a* of filter 12 constitutes a stationary valve seat. The above-mentioned indented part 25 which forms flap 14*a* extends inwardly from the gasket periphery beyond the point at which engagement is made with filter 12. This indentation may be made at only one place on the outer circumferential rim of the gasket 14, or at several places.

In the above-mentioned structure, when the compressed air from the air compressor is fed to the regenerating air reservoir, namely, during moisture-removal, as can be seen in FIG. 1, the oil in the compressed air A is trapped by the belt-shaped filter 12 while the compressed air A passes the belt-shaped filter 12, and it also passes through the adsorbent 11 just after that, so that the water in the compressed air A is trapped in this adsorbent 11. In this case, the thin flap 14*a* of the gasket 14 is energized upwardly into engagement with lower end 12*a* of filter 12, since the pressure of the compressed air A acts on the inside of the indented part 25. Accordingly, the contact area Y where the lower end 12*a* of the belt-shaped filter 12 contacts flap 14*a* of the gasket 14, becomes closed. At this time, the oil B entrapped by the belt-shaped filter 12 runs down along the inner circumferential surface of the hole-shaped pipe 12*x*, and reaches the inside of the above-mentioned contact area Y, i.e., in the space between filters 11 and 12.

Figure 3:
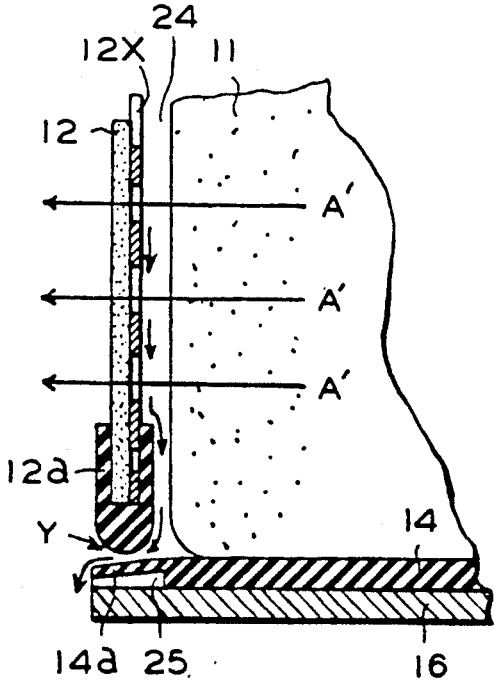
FIG. 3 is a view similar to FIG. 1 showing the invention in a different condition of operation.

Next, when the dried compressed air from the regenerating air reservoir is discharged via the drain discharge outlet, namely during regeneration, as can be seen in FIG. 3, the compressed air A′ absorbs the water of the adsorbent 11 while it is passing through the adsorbent 11, and it regenerates the adsorbent. Immediately thereafter it passes through the hole-shaped pipe 12*x* and the belt-shaped filter 12, and reaches the drain discharge outlet. In this case, the inside space of the belt-shaped filter 12 is at a higher pressure than atmospheric pressure since the compressed air A′ occupies the inside space. On the other hand, the outside space is the same as atmospheric pressure since the drain discharge outlet is open to the atmosphere, so that the thin flap 14*a* of the gasket 14 deflects (or changes its shape) downwardly due to the pressure difference between these spaces, and thus becomes disengaged from the lower end 12*a* of filter 12. Because of this, the above-mentioned contact area Y becomes open to atmosphere and the oil B, which ran down the inside of filter 12 to the contact area Y during the above-mentioned moisture-removal phase is forced by the backflow of compressed air to flow out past the open contact area Y. Then it is discharged through the drain discharge outlet and the discharge valve to atmosphere and thus does not accumulate.

Figure 5:
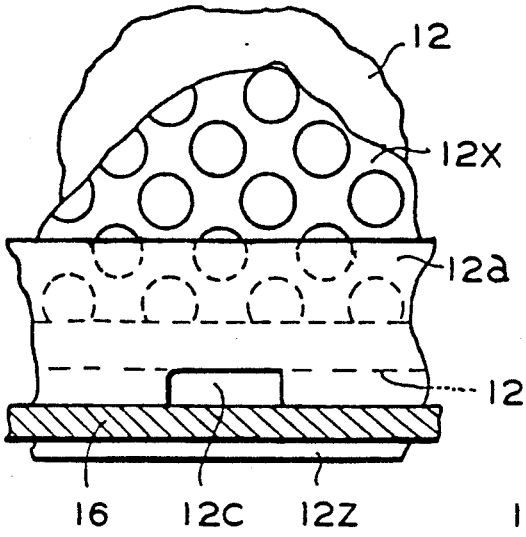
FIG. 5 is a fragmentary sectional elevation view taken along the lines V—V in FIG. 4.
Figure 4:
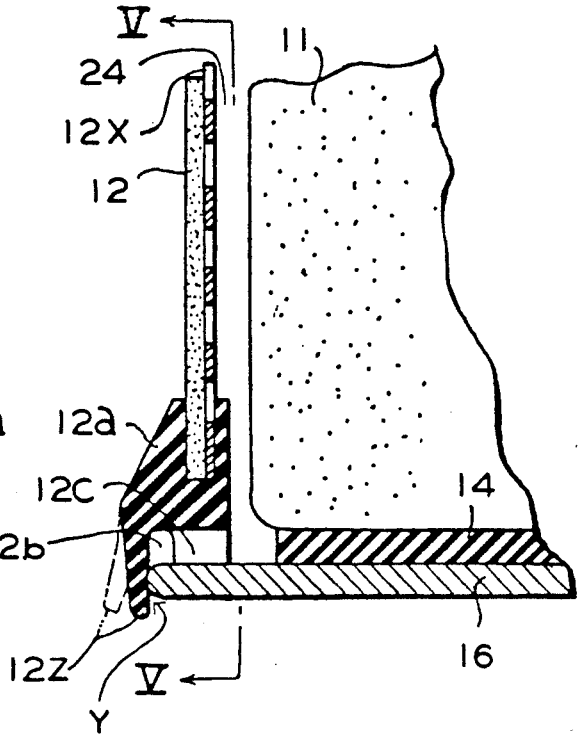
FIG. 4 is a fragmentary sectional elevation view illustrating a second embodiment of the invention.

FIGS. 4 and 5 illustrate the second embodiment of this invention. The second embodiment is different from the above-discussed first embodiment in that the diameter of the gasket 14 is smaller by a certain amount than the cap plate 16, and the sealing member 12*a*, which forms the lower end of the belt-shaped filter 12, is formed with a circular groove 12*b* along its entire circumference, an indented or undercut part 12*c* which connects to this circular groove 12*b* and has a specified width, and a thin extended flap 12*z* which hangs down vertically along the entire outer circumference of this circular groove 12*b*. Therefore, in this second embodiment there is provided an open-close, valve-like mechanism in which the outer circumferential surface of the above-mentioned cap plate 16 constitutes a valve seat which may be in contact with or separated from the inner circumferential surface of the thin extended flap 12*z* that constitutes a movable valve element. In this second embodiment, the vicinity of the indented part 12*c* constitutes the contact area Y that is opened and closed by flap 12*z*.

Therefore, also in this second embodiment, during moisture-removal, the thin extended flap 12*z* is deflected outwardly, due to the pressure difference, as is indicated by the dashed-line in FIG. 4, and the contact area Y becomes open. Because of this, the oil which ran down along the inner circumferential surface of the hole forming pipe 12*x* of the belt-shaped filter 12, is discharged to the outside with the regeneration air through the above-mentioned opening during regeneration.

As was described above, the oil, which was deposited on the belt-shaped filter during the moisture-removal and which runs down the inner surface and accumulates at the contact area where the gasket or the cap plate contacts the lower end of the belt-shaped filter, flows out from the contact area Y, which is open to atmosphere because the open-close valve mechanism is opened due to the air pressure (pressure difference) during regeneration. Therefore, the formation of the oil puddle and the remains of this puddle inside the contact area are prevented, so that substantially no oil enters the lower part of the adsorbent, which is located inside the belt-shaped filter at a specified location (or distance). In this manner, the life of the adsorbent is extended, which is an advantage.

I claim:

1. A moisture-removal device for use in a compressed air system including an air compressor for supplying air to a main reservoir via a regeneration reservoir comprising:

(a) a main body having a chamber, a first port via which said chamber is connected to said air compressor and a second port via which said chamber is connected to said regeneration reservoir;

(b) a filter assembly fixed in said chamber between said compressor and said regeneration reservoir, said filter assembly comprising:

(i) a first filter formed of adsorbent particles;

(ii) a second filter surrounding said first filter in spaced-apart relationship therewith to form a cavity therebetween;

(iii) upper and lower plate members between which said first and second filters are clamped; and (iv) seal means between said second filter and at least said lower plate member for interrupting fluid pressure communication between said cavity and said chamber; and (c) said seal means including differential pressure responsive valve means for establishing fluid pressure communication between said cavity and said chamber when said chamber is vented to atmosphere.

2. A moisture-removal device as recited in claim 1, wherein said valve means comprises:

(a) said seal means including an elastomeric gasket between said lower plate member and both said first and second filters, the outer periphery of said gasket having an undercut portion forming at least one flap member with a thickness less than a thickness of said gasket, said flap member constituting a movable valve element; and (b) said second filter at a lower end thereof adjacent an upper side of said gasket providing a valve seat with which said at least one flap member is engageable.

3. A moisture-removal device as recited in claim 2, wherein said undercut portion extends from an underside of said gasket at the outer periphery thereof inwardly to a point beyond a point of engagement of the upper side of said gasket with said lower end of said second filter.

4. A moisture-removal device as recited in claim 3, wherein said at least one flap member is a plurality of flap members, each of said flap member being formed by a respective undercut portion in the outer periphery of said gasket.

5. A moisture-removal device as recited in claim 2, wherein said valve seat comprises an elastomeric member fixed to said lower end of said second filter.

6. A moisture-removal device as recited in claim 5, wherein said flap member when engaged with said elastomeric member has a differential pressure area.

7. A moisture-removal device as recited in claim 1, wherein said valve means comprises:

(a) said lower plate member being formed at its outer periphery with a valve seat; and (b) said seal means being an elastomeric member fixed to said second filter between said lower end thereof and said lower plate member including a flap portion extending from said elastomeric member into engagement with said valve seat, said flap member constituting a movable valve element.

8. A moisture-removal device as recited in claim 7, wherein said elastomeric member is engageable with said surface of said lower plate member adjacent said lower end of said second filter, said elastomeric member further comprising at least one channel extending from the side of said elastomeric member in said space between said first and second filters to the inside of said flap.

9. A moisture-removal device as recited in claim 8, wherein said elastomeric member further comprises a continuous groove between the inside of said flap and said at least one said channel.

10. A moisture-removal device as recited in claim 9, further comprising an elastomeric gasket between said first filter and said lower plate member, the outer periphery of said gasket being spaced-apart from said elastomeric member.

11. A moisture-removal device as recited in claim 10, wherein said flap when engaged with said outer periphery of said lower plate member has a differential pressure area.

* * * * *